US006605364B1

(12) United States Patent
Conner et al.

(10) Patent No.: US 6,605,364 B1
(45) Date of Patent: Aug. 12, 2003

(54) COATING ARTICLE AND METHOD FOR REPAIRING A COATED SURFACE

(75) Inventors: Jeffrey Allen Conner, Hamilton, OH (US); Roger Dale Wustman, Loveland, OH (US); Jonathan Philip Clarke, West Chester, OH (US)

(73) Assignee: General Electric Company, Schenectady, NY (US)

( * ) Notice: Subject to any disclaimer, the term of this patent is extended or adjusted under 35 U.S.C. 154(b) by 61 days.

(21) Appl. No.: 09/618,576

(22) Filed: Jul. 18, 2000

(51) Int. Cl.[7] ..... B32B 15/04; F03B 3/12

(52) U.S. Cl. ..... 428/469; 428/632; 428/670; 428/678; 428/680; 416/241 R

(58) Field of Search ..... 428/623, 632, 428/633, 668, 670, 678, 680, 469; 416/241 B, 241 R

(56) References Cited

U.S. PATENT DOCUMENTS

| | | | | | |
|---|---|---|---|---|---|
| 3,544,348 | A | | 12/1970 | Boone et al. | 117/2 |
| 4,032,359 | A | | 6/1977 | Fisher et al. | 134/3 |
| 4,282,041 | A | | 8/1981 | Cork | 134/3 |
| 4,338,272 | A | | 7/1982 | Pelton et al. | 264/86 |
| 5,658,614 | A | | 8/1997 | Basta et al. | 427/253 |
| 5,702,288 | A | | 12/1997 | Liebke et al. | 451/36 |
| 5,723,078 | A | | 3/1998 | Nagaraj et al. | 264/36 |
| 5,856,027 | A | * | 1/1999 | Murphy | 428/623 |
| 6,001,492 | A | * | 12/1999 | Jackson et al. | 428/610 |

* cited by examiner

*Primary Examiner*—Deborah Jones
*Assistant Examiner*—Jennifer McNeil
(74) *Attorney, Agent, or Firm*—David L. Narciso; Lee H. Sachs

(57) ABSTRACT

A method is provided for repairing a surface portion of an article including a metallic environmental resistant coating on a substrate. The coating includes a coating outer portion bonded with the substrate through a diffusion zone that includes at least one feature, for example Al and/or an intermetallic phase, in an amount detrimental to application of a metallic replacement coating and/or repair of the article. The method comprises removing the coating outer portion to expose a surface of the diffusion zone. The substrate and the diffusion zone are heated at a temperature and for a time sufficient to diffuse and/or dissolve at least a portion of the at least one feature in the exposed surface and in a portion of the diffusion zone beneath the exposed surface to a level below the detrimental amount. This provides a replacement surface portion integral with diffusion zone. Then a metallic replacement coating outer portion is applied to the replacement surface portion. Provided is a coated article comprising a substrate and a metallic environmental resistant coating bonded with the substrate. The coating comprises an inner modified portion of the substrate integral with the substrate, an outer diffusion zone integral with the inner portion, and a metallic environmental resistant coating outer portion integral with the outer diffusion zone. In some forms, the coated article includes a thermal barrier coating over the metallic coating outer portion.

7 Claims, 1 Drawing Sheet

COATING ARTICLE AND METHOD FOR REPAIRING A COATED SURFACE

BACKGROUND OF THE INVENTION

This invention relates to a method for repairing a surface portion of a coated article and to a repaired coated article. More particularly, it relates to a recoated article and method for recoating an article having a high temperature alloy substrate and a coating including Al on the substrate, the coating including a diffusion zone at the substrate.

Certain components of power generating apparatus, for example a turbine engine, operate in the hot gas path of the apparatus. In the turbine section of a gas turbine engine, components are subjected to significant temperature extremes and contaminants present in combustion gases. As a result of operating in such an environment, components are subject to degradation by oxidation and/or hot corrosion. To combat environmental attack, it has been a common practice in the art to protect at least an outer surface portion of such components with an environmental resistant coating. As has been widely reported in the art, many of such coatings include Al, sometimes modified with secondary elements such as one or more of Pt, Rh, Pd, Cr, Si, Hf, Zr, and Y.

In addition to degradation during service operation, difficulties in such coatings can arise during initial manufacture. For example, unacceptable coatings have been identified on a component after heat treatment and as a result of evaluation of the quality of the coating.

Generally, such coatings, forms of which frequently are referred to as aluminide coatings, during or after application to an article surface are subjected to a heat treatment that interdiffuses elements of the coating and the substrate. For example, for slurry type coatings and some pack cementation coatings, the thermal cycle used to diffuse the aluminum into a component surface is conducted after the coating cycle. Such heat treatment forms a diffusion zone between the substrate and an outer portion of the coating. One example is application of an aluminide type coating to an outer wall portion of an air-cooled gas turbine engine component, such as a rotating blade or a stationary vane or strut. The diffusion zone becomes an integral part of the component wall, generally designed to have a particular allowable thickness range based at least in part on considerations of heat transfer and structural strength. The thickness and extent of the diffusion zone can be controlled through processing parameters such as the coating time, coating and heat treatment temperature, and aluminum activity of the coating ingredients and conditions.

Difficulties or degradation related to the coating and/or to the coated article at the manufacturing level, as well as that which occurs during engine service operation, often necessitates removal and replacement of such protective coatings as well as repair of the component itself. As used herein, the term "repair" is intended to include one or the combination of repairs of the structure of the article, as well as replacement of the coating. Such repair of the component can include operations such as welding and/or braze repairing of cracks prior to replacement of the coating. The presence of an alumninide coating and its ingredients has been found to be incompatible with and detrimental to such article repair and coating replacement operations.

One example of known removal of a diffusion aluminide coating from a surface portion of an article, in preparation for article repair and/or coating replacement, has been to remove both the aluminide coating outer portion, generally rich in Al, as well as the coating diffusion zone, generally including elements from the coating outer portion and the substrate, as well as intermetallic phases. Such removal has been accomplished by a combination of mechanical abrasion and chemical stripping that removes from the substrate the outer layer and the diffusion zone portion of the coating.

According to known methods, complete removal of the aluminide coating, including the diffusion zone, from the balance of the substrate has been conducted to provide a surface that can be repaired, such as by brazing and/or welding operations, and recoated using a range of selected coatings and coating processes. For example, the presence of certain amounts of such detrimental elements as Al and/or intermetallic phases above an acceptable amount, can affect, adversely, article repair as well as the reapplication of certain environmentally protective coatings. One reported type of such a replacement protective coating includes first electrodepositing on a surface a noble metal such as Pt and then aluminiding that surface. In some examples of that type of replacement coating, unfavorable processing reactions have been observed to result, during the application of such a coating, from the presence of undesirable amounts, for example greater than that in the substrate, of residual elements such as Al from the diffusion zone, as well as certain intermetallic phases. In addition to inhibiting repair processes, presence of amounts of such element or intermetallics, or their combination, can reduce plating adhesion and inhibit the plated metal from diffusing into the substrate. As used herein, the term "undesirable feature" is intended to mean one or more of at least one undesirable element and/or at least one undesirable intermetallic phase that can be detrimental to the repair and/or replacement coating of an article.

A necessary result of removing both the coating outer portion and the coating diffusion zone, as has been conducted in known methods, is loss of wall thickness of an article. A reduced wall thickness can approach a limit for structural strength and, in any event, can reduce the total operating life of an article by limiting its potential for subsequent repair of the article coating. In addition, for air-cooled articles including cooling air discharge openings in a wall that has had its thickness reduced, loss of airflow control can occur as a result of change in size and/or shape of the openings. Removal of the diffusion zone at the surface of an opening, such as a hole, means that the size of the opening has been enlarged.

BRIEF SUMMARY OF THE INVENTION

One form of the present invention comprises a method for repairing a surface portion of an article that comprises a substrate of an alloy, and a metallic environmental resistant coating on the substrate. The coating includes a coating outer portion bonded with the substrate through a coating diffusion zone that includes at least one undesirable feature in an amount detrimental to application of a replacement coating and/or a repair operation. The method comprises removing the coating outer portion to expose a surface of the diffusion zone. The substrate and the diffusion zone, integral with the substrate, are heated at a temperature and for a time sufficient to reduce the presence of the at least one undesirable feature to a level below the amount. The heating results in dissolution of at least a portion of one detrimental intermetallic phase and/or diffusion of at least a portion of one detrimental element of the undesirable feature in the exposed surface of the diffusion zone and in a portion of the diffusion zone beneath such surface away from the exposed surface and portion and toward the substrate. This diffusion changes the exposed surface of the diffusion zone and the portion beneath the exposed surface to a replacement surface portion integral with an underlying coating diffusion zone and of a reduced, acceptable level or amount of the at least one undesirable feature. The replacement surface portion is integral with the underlying diffusion zone and portion at the substrate. Then the replacement surface portion is repaired, for example including applying a metallic replacement coating outer portion to the replacement surface portion. In one form of applying a replacement coating that includes heating of the replacement coating outer portion, for example during application, inward diffusion of at least one element of the replacement coating outer portion occurs. This provides the replacement surface portion as a new, outer diffusion zone portion integral with the replacement coating outer portion, and over and integral with an inner modified substrate portion at the substrate. In one form, a thermal barrier coating is applied over the metallic replacement outer coating.

One form of the present invention provides a coated article comprising a substrate of an alloy, an inner modified portion of the substrate, an outer diffusion zone integral with the inner modified substrate portion, and a metallic environmental resistant coating outer portion integral with the outer diffusion zone. In one embodiment, a thermal barrier coating is over the metallic coating outer portion.

DETAILED DESCRIPTION OF THE INVENTION

Figure 1:
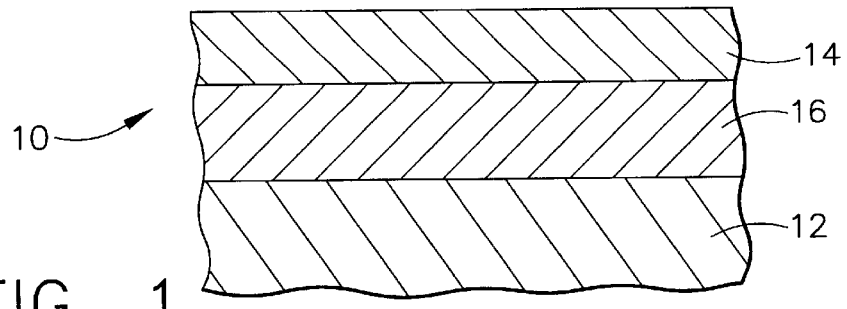
FIG. 1 is a diagrammatic, fragmentary sectional view of an article coated with a metallic diffusion aluminide coating.

A variety of high temperature environmental resistant coatings including Al have been used and widely reported in connection with components of gas turbine engines. One frequently used type generally is referred to as a metallic diffused aluminide coating, including an outer Al-rich portion and a portion, sometimes called the diffusion zone, diffused with an underlying portion. For example, such an underlying portion has been a high temperature alloy substrate based on at least one of Fe, Co, and Ni, for example a Ni based superalloy. Diffused aluminide coatings have been applied by a variety of reported processes including pack cementation, above the pack, vapor phase, chemical vapor deposition and slurry coating. The thickness and the aluminum content of the final coating can be controlled by varying coating time, coating temperature, and the aluminum activity of the source material used in the coating process. In some embodiments, diffused aluminide coatings are applied over a deposit of a noble metal such as Pt to provide the well-known Pt—Al type of environmental resistant coating. In some applications well known in the gas turbine engine art, metallic aluminide coatings function as a bond coat beneath a thermal barrier coating (TBC) disposed over the metallic coating.

It is believed that a diffusion zone of a diffusion aluminide coating on a typical Ni base superalloy substrate forms as a result of decreased solubility of many elements in the substrate. This results from inward diffusion of Al from the coating into the substrate and outward diffusion of Ni from the substrate to form a NiAl outer or additive layer. The change in local composition results in the precipitation of intermetallic phases in an amount that has been observed to be detrimental to subsequent repair.

Forms of the present invention prepare an article for repair by generating a surface that can be both repaired, such as by brazing and/or welding operations, and can be recoated using a variety of selected coating processes or approaches. This is accomplished through reducing, by appropriate diffusion type heat treatment, amounts of undesirable features to below a detrimental amount without removing the entire diffusion zone, as is done in current methods. The diffusion heat treatment cycle used in connection with the present invention provides a unique replacement surface portion for repair and/or to receive a replacement coating. Such heat treatment allows Ni to diffuse from the substrate into an exposed, residual diffusion zone and allows existing precipitated elements to return into a solid solution with Ni. Then application of a metallic diffusion replacement coating on the replacement surface portion creates on a substrate a new type of coating system comprising, in sequence, a metallic environmental resistant coating outer portion, an outer diffusion zone, and an inner modified substrate portion integral with the substrate.

This structure of the present invention results during application of the replacement diffusion coating by diffusing Ni from the substrate surface to form the replacement coating while diffusing an element such as Al from the replacement outer portion. In more simple Ni base superalloys, it is believed that the inner modified substrate portion is distinguished from a typical diffusion zone in that the Al is elevated and the Ni level is depressed, with the actual composition of the inner modified substrate portion heavily dependent on the substrate chemistry. In more highly alloyed Ni base superalloys, for example of the type sometimes called Rene' N5 alloy, having a relatively high volume fraction of gamma prime phase, the inner modified substrate portion can be considered to be a distinct, inner diffusion zone integral with the substrate.

When damage or degradation occurs in connection with a metallic environmental resistant coating and/or the structure of a coated article during or as a result of manufacture, or from service operation, generally it is more economical or practical to repair rather than replace the article. The presence of certain amounts of an aluminide coating or certain of its ingredients (undesirable features) is not compatible with certain repair operations, for example welding and/or brazing of cracks. In addition, the presence of such amounts of certain undesirable elements, for example Al, can interfere with the application and diffusion into a substrate of certain protective coatings. In general, surface portions with Al levels above about that of the substrate alloy have been observed to be relatively difficult to weld. In some cases, the degree of alloy weldability has been estimated from the combined content of such elements as Al and Ti. The present invention returns the surface to be repaired and/or recoated to approach the substrate composition and structure.

It has been one practice in connection with diffusion aluminide coatings to prepare an article surface portion for repair by removing the entire coating including the diffusion zone as well as the outer Al-rich portion of the coating. For example, such removal has been conducted using a combination of mechanical abrasion and chemical stripping which removes the entire coating including the diffusion zone.

Complete removal of a coating, including the diffusion zone, currently has been especially important when coating repair or replacement involves a multiple step coating process. One example is the two-step Cr—Al process. Another is the multiple step noble metal modified aluminide type of coating, for example in which a noble metal such as Pt first is electrodeposited on and diffused into a surface before or during subsequent aluminiding. Certain amounts, for example substantially greater than that in a substrate, of residual diffusion zone phases and/or residual Al in a surface portion on which a replacement coating is to be deposited, particularly of the multiple step type, has resulted in unfavorable processing reactions during application of a replacement coating as well as during brazing and welding operations. Typical unfavorable processing reactions include kirkendahl voiding, Pt deposit spalling, and incipient melting of residual phases during diffusion heat treatment of Pt.

As was discussed above, complete coating removal including removal of the diffusion zone results in loss of wall thickness. For gas turbine engine articles including air cooling holes intersecting surfaces with a coating, loss of thickness from such complete coating removal can result in a wall thickness below a minimum design requirement and can result in change of hole size and shape, resulting in loss of airflow control. The present invention, in one form, provides a method for preparing a surface portion of a coated article for repair by removing a non-protective or defective diffused type outer coating portion on the article surface, and preparing the residual diffusion zone and substrate portion for repair. For example, such repair can include one or more of welding, brazing and application of a replacement coating. Such preparation is accomplished without complete removal of the entire outer coating portion, retaining diffusion zone material to substantially avoid reduction in wall thickness of an article wall on which a diffusion coating has been applied.

As was mentioned above, the presence of certain amounts of an aluminide type of coating can be detrimental to repair of an article. Practice of forms of the present invention eliminates potential repair problems by eliminating both an elevated, undesirable Al amount and undesirable amount of intermetallic phases formed in the diffusion zone of an original diffusion aluminide coating, each of which can have melting points below selected repair processing temperatures. In addition, elimination of undesirable amounts of intermetallic phases is important to successful deposition of Pt in a replacement coating. The presence of such amounts of intermetallic phases at the surface on which the Pt is being deposited reduces Pt adhesion and acts as a barrier to subsequent Pt diffusion into the substrate. The presence of elevated, undesirable Al amounts at the surface on which Pt is being electroplated, in addition to the presence of intermetallic phases due to altered surface chemistry, can lead to smutting of the surface to be plated during exposure to the chemical bath sequence used to electroplate Pt.

The present invention will be more fully understood by reference to the drawings. FIG. 1 is diagrammatic, fragmentary sectional view of an article including a diffused environmental resistant coating shown generally at 10 on a substrate 12. Coating 10, which in this embodiment is a metallic diffusion aluminide coating, includes an Al-rich coating outer portion 14, sometimes called an additive portion, and a coating diffusion portion 16 disposed between each of substrate 12 and coating outer portion 14. Coating diffusion portion 16, integral with substrate 12, includes elements, including Al, diffused from coating outer portion 14 and from substrate 10. In some embodiments, an additional outer thermal barrier coating (TBC), for example a ceramic TBC based on zirconia stabilized with yttria, (not shown), has been applied over environmental resistant coating 10, as is well known and used in the gas turbine art.

Figure 2:
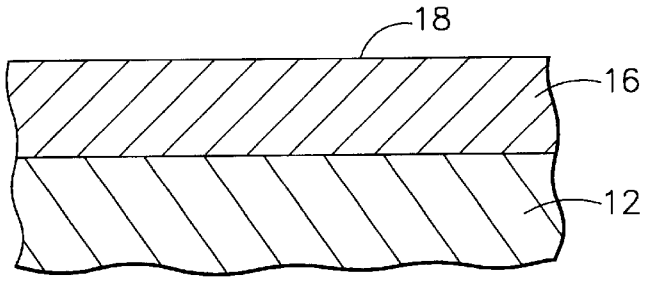
FIG. 2 is a diagrammatic, fragmentary sectional view as in FIG. 1, with a coating outer portion removed to expose a coating diffusion zone surface.

In the practice of one form of the present invention, coating outer portion 14 is removed as presented in the diagrammatic fragmentary sectional view of FIG. 2, such as by one or a combination of chemical and mechanical means used in the art for such purpose. Such removal is conducted to an extent sufficient to expose a diffusion zone surface 18 of diffusion zone 16 substantially without removing all of diffusion zone 16, thereby retaining substantially the thickness of the combination of substrate 12 and diffusion zone 16. For example, when substrate 12 represents a wall of an air-cooled turbine engine component, the wall thickness of the component substantially is retained.

After exposing diffusion zone surface 18, substrate 12 and diffusion zone 16, including surface 18, are heated in a non-oxidizing atmosphere for a time sufficient to diffuse Al in surface 18 and in a portion of diffusion zone 16 beneath surface 18 toward substrate 12 and to diffuse Ni from the substrate into diffusion zone 16. Increased Al levels decrease solubility of various elements, resulting in precipitation of phases that did not exist prior to increasing the local Al content. Therefore, an increased Al content is indicative of the potential for the occurrence of the above described type of problems. In this embodiment, Al is representative of an element that, in undesirable amounts, can cause unfavorable processing reaction during, and thereby is detrimental to application of, a replacement environmental resistant coating particularly of the above-described multiple step type. As discussed above, other features that can cause an unfavorable processing reaction include intermetallic phases.

Figure 3:
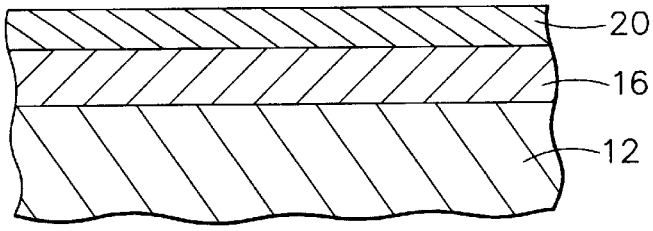
FIG. 3 is a diagrammatic, fragmentary sectional view as in FIG. 2 after dissolution of amounts of undesirable intermetallic phases and depletion of Al from the exposed surface and underlying portion to provide a replacement surface portion.

The above described diffusion of elements, such as Al and Ni, and/or dissolution of intermetallic phases, provides a replacement surface portion 20, with reduced amounts of undesirable features and integral with but distinct from diffusion zone 16, as shown in the diagrammatic fragmentary sectional view of FIG. 3.

The levels of undesirable features below an undesirable amount in replacement surface portion 20 enables welding and/or brazing which could not effectively be performed without reduction in Al, and the successful application, over replacement surface portion 20, of an Al-rich replacement coating outer portion 22, FIG. 4. A form of the present invention enables such application to be made without detriment to the replacement coating outer portion 22 of a replacement coating shown generally at 24. One form of application of such a replacement coating outer portion 22 includes aluminiding at an elevated temperature. In that coating method, concurrently with deposition of coating material, the above described interdiffusion occurs at least between the replacement surface portion 20 disposed for coating as shown in FIG. 3, and both original diffusion zone 16 and replacement coating outer portion 22. Such diffusion includes migration of at least one element from replacement coating outer portion 22 and at least one element from original diffusion zone 16 into replacement surface portion 20. This diffusion provides a new coating component, an outer diffusion zone 26 beneath replacement coating outer portion 22, of environmental resistant coating 24.

Figure 4:
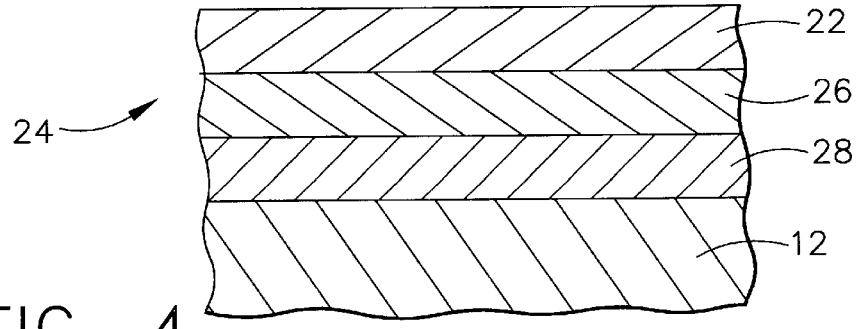
FIG. 4 is a diagrammatic, fragmentary sectional view of an article including, in sequence, an outer metallic replacement additive coating portion, an outer diffusion zone, an inner modified substrate portion, and a substrate.

As shown in FIG. 4, this interdiffusion results in the generation beneath replacement outer coating portion 22 of an outer diffusion zone 26 and an inner modified substrate portion 28, bonded together yet distinct one from the other, at least by composition and/or structure. Therefore, in the embodiment of FIG. 4, article alloy substrate 12 is integral with an environmental resistant coating comprising, in sequence outwardly from the substrate, an inner modified substrate portion, an outer diffusion zone, and a coating outer portion.

In one evaluation of the present invention, air-cooled gas turbine engine turbine blades were inspected after service operation. The turbine blades were made of a Ni-base superalloy sometimes referred to as Rene' 80 alloy, forms of which are described in U.S. Pat. No. 3,615,376—Ross et al (patented Oct. 26, 1971). Inspection disclosed degradation, on the air cooled wall of certain blade airfoils, of a metallic diffusion aluminide environmental resistant coating of the type commercially available as Codep aluminide coating, forms of which are described in such U.S. Pat. Nos. 3,540,878 and 3,598,638. The Codep aluminide coating, similar to the arrangement shown in FIG. 1, included an outer Al-rich portion 14 over a diffusion zone 16, that included Al diffused from outer Al-rich portion 14. Also, diffusion zone 16 was integral with the Ni-base substrate 12 from which it had been formed. The degradation of the aluminide coating was sufficiently severe to require coating removal and replacement before the article could be returned to service.

It has been observed that adverse processing reactions occurred when an amount of Al greater than about 10 wt. % of the substrate maximum level was present in such an article surface at which disposition of a replacement aluminide diffusion coating, particularly of the above described multi-step Pt—Al type and/or repair, was conducted. Such negative reactions observed include poor Pt adherence, incipient melting of intermetallic phases, and lack of braze flow due to residual coating acting as a stop-off material. Therefore, in these examples replacement of the coating was conducted according to a form of the present invention by removing substantially only the outer Al-rich outer portion 14 to expose a surface 18 of diffusion zone 16, as in FIG. 2. This retained the article wall thickness within a design wall thickness range. Removal was by application of a nitric/phosphoric acid solution stripping followed by light grit blasting to remove smut formed during the stripping operation. Thereafter, the exposed surface 18, diffusion zone 16 and substrate 12, in this example conveniently the entire turbine blade, was heated in a non-oxidizing atmosphere, in this evaluation a vacuum. Such heating was conducted at a temperature and for a time sufficient to dissolve undesirable intermetallic phases and to interdiffuse, as described above, the Al in the exposed surface 18 and in a portion of diffusion zone 16 beneath surface 18 and Ni from the Ni-base alloy substrate 12. For Ni-base superalloys, such heating can be conducted within the range of about 1800° F. to less than the incipient melting temperature of the alloy, typically in the range of about 1900–2000° F. The time of heating was in the range of about 1–16 hours, typically for about 4–8 hours. This substantially eliminated the original diffusion zone. It provided a replacement surface portion 20 from the exposed surface 18 and a portion of the diffusion zone beneath exposed surface 18, in a condition in which the Al content substantially was about that of the substrate and more receptive to subsequent repair and/or coating.

In one series of examples, a multi-step Pt—Al aluminide replacement coating then was applied by first electrodepositing Pt by on replacement surface 20 to a thickness of about 2–10 microns. The deposit was heated in the range of about 1700–2050° F., in one specific example about 1925–1975° F., for about ½–4 hours, to diffuse the Pt with the surface. Then that Pt surface was diffusion aluminided in the range of about 1900–2000° F. using the above identified above the pack aluminide coating method.

This aluminiding at elevated temperature and the above described interdiffusion between portions and zones resulted in the type of structure shown in FIG. 4. Such structure comprised the Ni base superalloy substrate 12 and Al-rich replacement coating outer portion 22 including Pt, with a pair of bonded zones 26 and 28 there-between.

Forms of the present invention provide a replacement coating while retaining wall thickness of the air-cooled airfoil wall within a design limit range. Retention of such wall thickness, according to embodiments of the present invention, provided the article with enhanced capability for any necessary subsequent coating repair. Although the present invention has been described in connection with specific examples and embodiments, they are intended to be typical of rather than in any way limiting on the scope of the present invention. Those skilled in the various arts involved will understand that the invention is capable of variations and modifications without departing from the scope of the appended claims.

What is claimed is:

1. A caoted article comprising:

a substrate of an alloy;

a modified portion of the substrate integral with the substrate and modified to include a reduced presence of at least one undesirable feature to below an amount detrimental to at least one of application of a replacement coating and a repair operation; and, a metallic environmental resistant coating bonded and interdiffused together with the modified substrate portion, the coating comprising:

a) a metallic environmental resistant coating outer portion; and, b) an outer diffusion zone interdiffused with the outer portion of the metallic environmental resistant coating and with the modified substrate portion, the outer diffusion zone including at least one element diffused from the metallic environmental resistant coating outer portion and at least one element diffused from the modified portion of the substrate.

2. The article of claim 1 in which:

the alloy is a high temperature alloy based on at least one element selected from the group consisting of Fe, Co and Ni; and, the outer diffusion zone and the environmental resistant coating outer portion include Al.

3. The article of claim 2 in which the alloy is a Ni base superalloy.

4. The article of claim 3 in which the environmental resistant coating outer portion includes Pt.

5. The article of claim 3 in the form of a turbine engine article including an airfoil, the metallic environmental resistant coating being bonded with the airfoil.

6. The article of claim 5 in which a thermal barrier coating is disposed over the metallic environmental resistant coating.

7. The coated article of claim 1 in which:

the outer diffusion zone includes at least one element diffused from the metallic environmental resistant coating outer portion and at least one element diffused from the inner modified portion of the substrate; and, the inner modified portion of the substrate includes at least one element diffused from the outer diffusion zone and at least one element diffused from the substrate.

* * * * *